US009083105B2

(12) United States Patent
Wei et al.

(10) Patent No.: US 9,083,105 B2
(45) Date of Patent: Jul. 14, 2015

(54) COVER MODULE

(71) Applicant: Wistron Corporation, New Taipei (TW)

(72) Inventors: Ren-Jing Wei, New Taipei (TW); Kuo-Wei So, New Taipei (TW); Tsung-Ying Tsai, New Taipei (TW)

(73) Assignee: Wistron Corporation, New Taipei (TW)

( * ) Notice: Subject to any disclaimer, the term of this patent is extended or adjusted under 35 U.S.C. 154(b) by 52 days.

(21) Appl. No.: 14/148,231

(22) Filed: Jan. 6, 2014

(65) Prior Publication Data

US 2014/0213081 A1 Jul. 31, 2014

(30) Foreign Application Priority Data

Jan. 30, 2013 (TW) ..... 102103517 A

(51) Int. Cl.
*H01R 13/44* (2006.01)
*H01R 13/453* (2006.01)

(52) U.S. Cl.
CPC ..... *H01R 13/4534* (2013.01); *H01R 2201/06* (2013.01)

(58) Field of Classification Search
CPC . H01R 13/447; H01R 13/453; H01R 13/4534
USPC ..... 439/135–137, 38–40
See application file for complete search history.

(56) References Cited

U.S. PATENT DOCUMENTS

| | | | | |
|---|---|---|---|---|
| 3,868,160 | A * | 2/1975 | Kersman | 439/39 |
| 8,143,983 | B1 | 3/2012 | Lauder et al. | |
| 2010/0190368 | A1* | 7/2010 | Christensen et al. | 439/188 |
| 2013/0017696 | A1* | 1/2013 | Alvarez Rivera | 439/136 |

FOREIGN PATENT DOCUMENTS

| | | |
|---|---|---|
| TW | M409599 | 12/2010 |

* cited by examiner

*Primary Examiner* — Felix O Figueroa
(74) *Attorney, Agent, or Firm* — The Mueller Law Office, P.C.

(57) ABSTRACT

A cover module includes a housing provided with a connecting hole, a cover unit disposed in proximity to the connecting hole and movable between closed and open positions that respectively closes and opens the connecting hole, a magnetic member disposed in the housing, a biasing member biasing the cover unit toward the closed position, and a limiting mechanism having a limiting plate cooperating with the housing to define a receiving slot which restricts sliding movement of the magnetic member therewithin. When an electronic component approaches the connecting hole, the magnetic member is magnetically pulled to move toward the connecting hole, simultaneously pushing the cover unit to the open position.

14 Claims, 8 Drawing Sheets

COVER MODULE

CROSS REFERENCE TO RELATED APPLICATION

This application claims priority of Taiwanese Application No. 102103517, filed on Jan. 30, 2013.

BACKGROUND OF THE INVENTION

1. Field of the Invention

The invention relates to a cover module, more particularly to a cover module having automatic opening and closing functions.

2. Description of the Related Art

A connector device of an existing electronic device usually includes a socket connector installed within a housing of the electronic device, and a plug connector plugged into the socket connector from an outer side of the housing. The plug connector can be removably inserted into the socket connector through a connecting hole provided in the housing. To prevent dust from entering the housing via the connecting hole that may cause damage to the electronic device, a dustproof cover module is provided on the housing for openably closing the connecting hole. The connecting hole is opened only when the plug connector is to be plugged into the socket connector. Through this, the effects of preventing dust from entering the housing and maintaining an aesthetic appearance of the housing can be achieved.

However, the existing dustproof cover module is very inconvenient to use because it needs to be manually opened or closed. That is, when a user wants to connect the connector device, he/she has to free one of his/her hands first to open the dustproof cover module, and then uses his/her other hand to grasp the plug connector for plugging into the socket connector. This is not only inconvenient, but also time consuming. In addition, he/she has to see and confirm the position of the dustproof cover module prior to opening the dustproof cover module, so that it is necessary for the user to move his/her line of sight which may result in an ongoing operation of the electronic device being forcedly interrupted.

Moreover, the housing of the electronic device is usually disposed in a narrow and dark space, such as under the table, so that the user often has to go under the table to confirm the position of the dustproof cover module for opening the latter. It can be seen that there is room for improvement for the conventional dustproof cover module.

SUMMARY OF THE INVENTION

Therefore, an object of the present invention is to provide a cover module having automatic opening and closing functions.

According to the present invention, a cover module is used for installation in an electronic device. The cover module is opened when a first electronic component having a metal housing made of a magnetic material approaches the cover module. The cover module comprises a housing, a cover unit, a magnetic member, a biasing member and a limiting unit. The housing is provided with a connecting hole communicating with inner and outer portions thereof. The cover unit is disposed in the housing in proximity to the connecting hole, and is movable between a closed position, where the cover unit closes the connecting hole, and an open position, where the cover unit opens the connecting hole. The cover unit includes a cover plate for covering the connecting hole, and a connecting plate connected to the cover plate.

The magnetic member is disposed in the housing. When the first electronic component approaches the connecting hole, the magnetic member is magnetically pulled by the metal housing of the first electronic component to move toward the connecting hole, simultaneously pushing the connecting plate to shift the cover unit from the closed position to the open position. The biasing member is connected to the housing and the connecting plate for biasing the cover unit toward the closed position.

The limiting unit is fixed to the housing and includes a first limiting mechanism. The first limiting mechanism includes a first limiting plate that cooperates with the housing to define a first receiving slot which receives slidably the magnetic member and which restricts sliding movement of the magnetic member therewithin.

The efficiency of the present invention resides in that by providing the movable magnetic member, when the metal housing of the first electronic component approaches the connecting hole, the magnetic member is magnetically pulled to displace, simultaneously pushing the cover unit to move to the open position. Further, through contact of the magnetic member with the connecting plate, when the metal housing of the first electronic component is moved away from the connecting hole, the cover unit is biased by the restoring force of the biasing member to automatically return to the closed position. Hence, the effect of automatically opening and closing the cover module can be achieved.

BRIEF DESCRIPTION OF THE DRAWINGS

Other features and advantages of the present invention will become apparent in the following detailed description of the embodiments with reference to the accompanying drawings, of which.

DETAILED DESCRIPTION OF THE PREFERRED EMBODIMENTS

Figure 1:
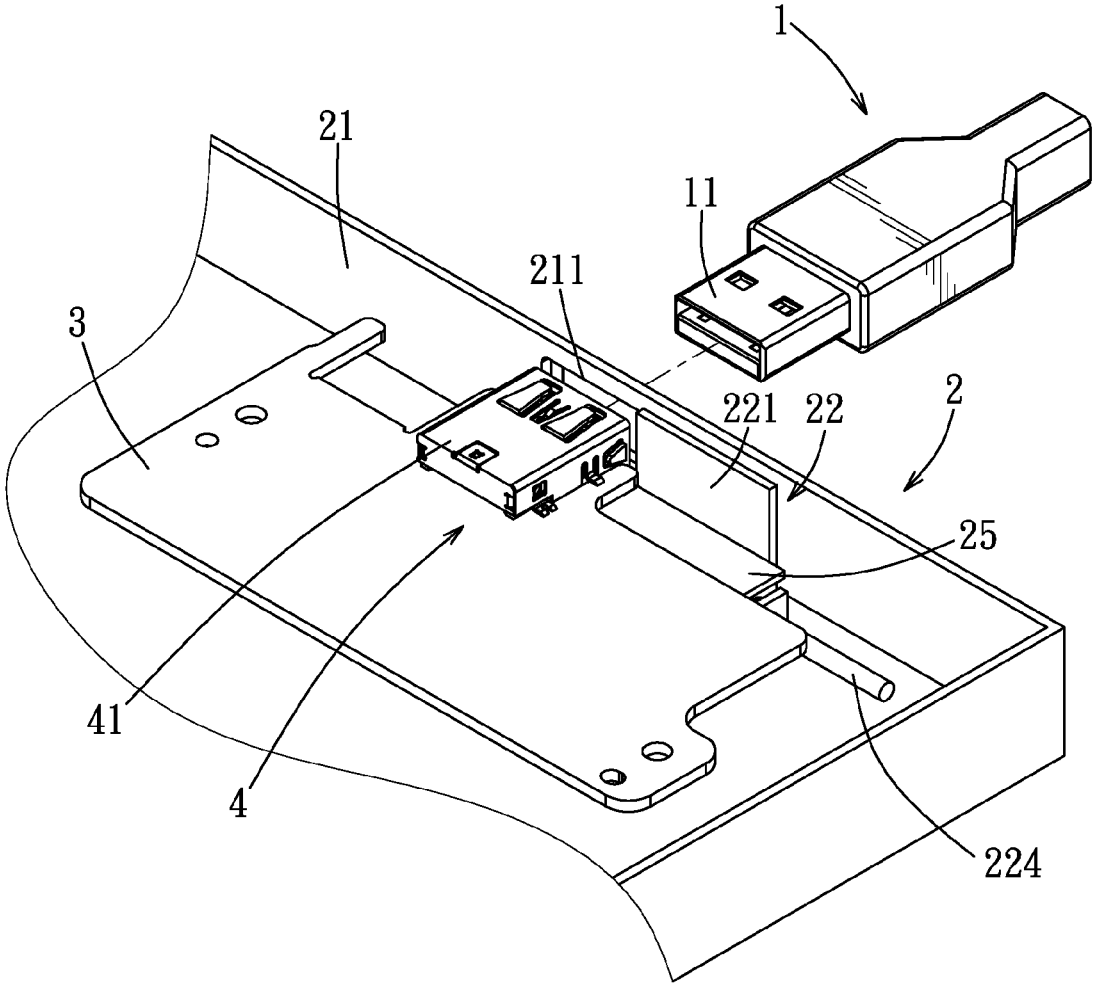
FIG. 1 is a fragmentary perspective view of a cover module according to the first embodiment of the present invention.
Figure 2:
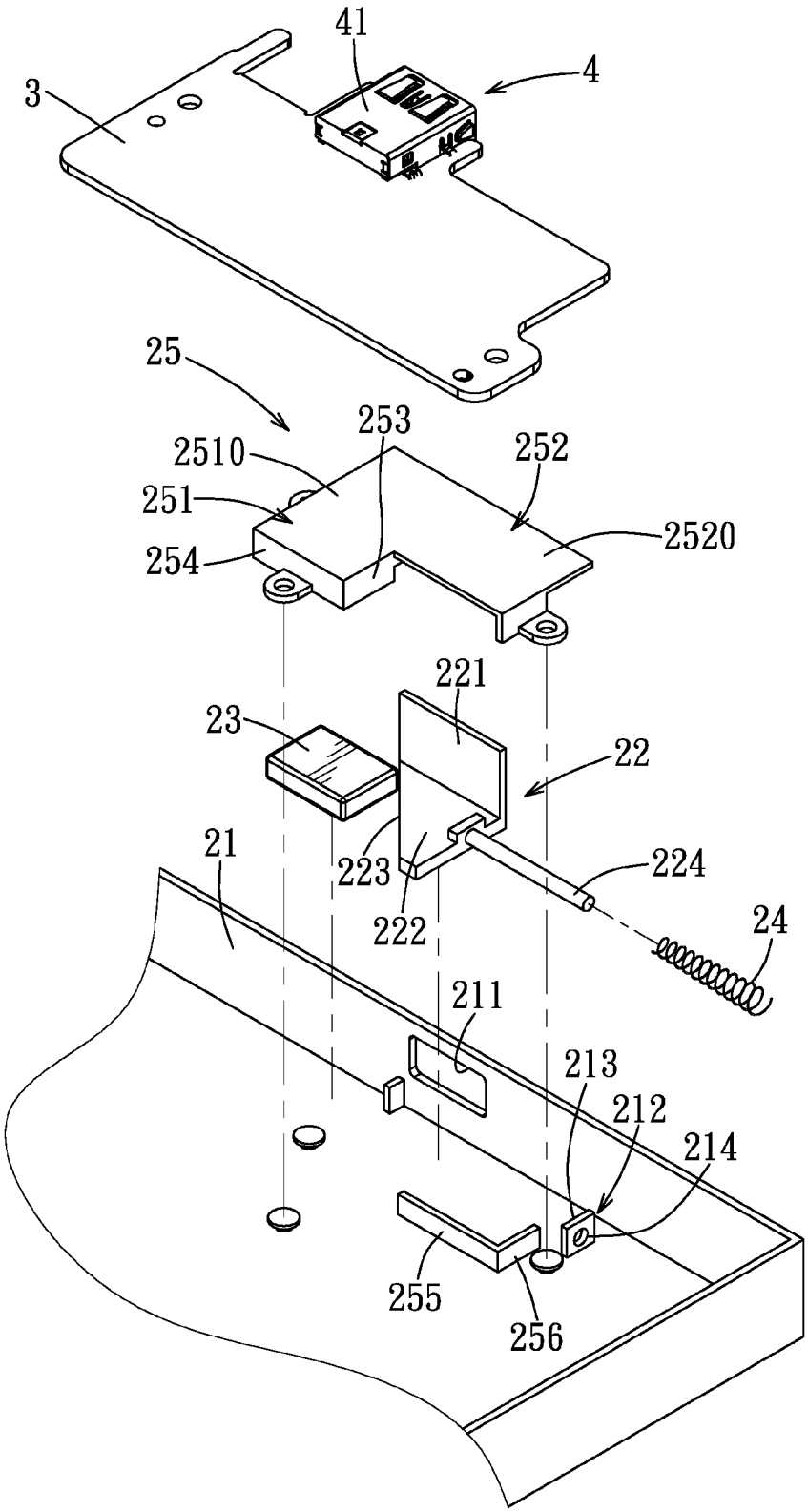
FIG. 2 is an exploded perspective view of the cover module of the first embodiment.

The above-mentioned and other technical contents, features, and effects of this disclosure will be clearly presented from the following detailed description of two embodiments in coordination with the reference drawings.

Before this invention is described in greater detail, it should be noted that similar elements are designated by the same reference numerals throughout the disclosure.

Referring to FIGS. 1 to 4, the first embodiment of a cover module 2 according to the present invention is adapted to be installed in an electronic device (not shown) to serve as a dustproof cover module. When a first electronic component having a metal casing made of a magnetic material approaches the cover module 2, the cover module 2 will open. In this embodiment, the first electronic component is a plug connector 1, and the metal casing of the first electronic component is a plug metal casing 11. The cover module 2 comprises a housing 21, a cover unit 22, a magnetic member 23, a biasing member 24, a limiting unit 25, a circuit board 3, and a second electronic component for detachable connection with the first electronic component. In this embodiment, the second electronic component is a socket connector 4.

Figure 6:
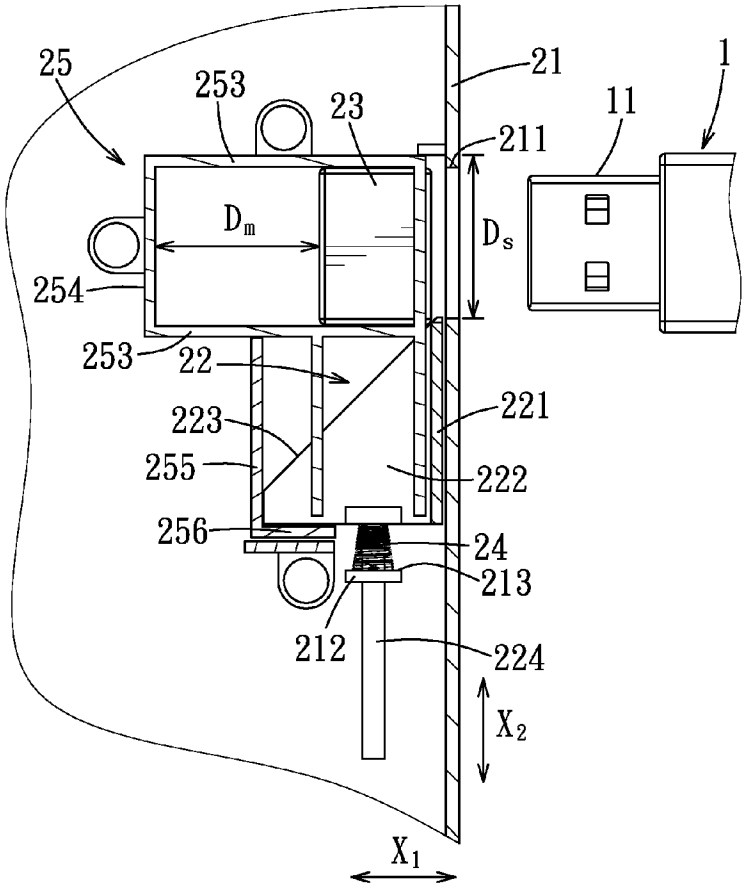
FIG. 6 is a view similar to FIG. 5, but illustrating the cover unit in an open position.
Figure 5:
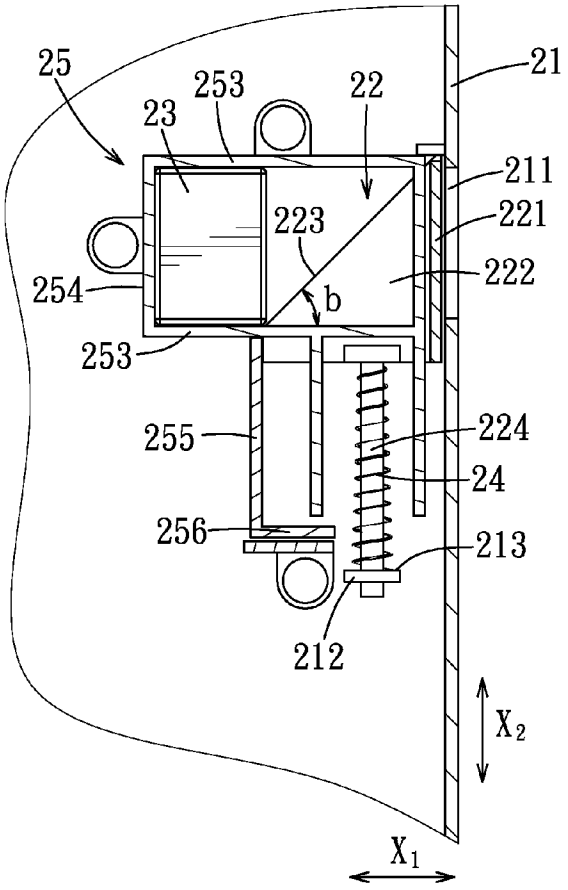
FIG. 5 is a fragmentary sectional top view of the first embodiment, illustrating a cover unit in a closed position.

The housing 21 is provided with a connecting hole 211 communicating with inner and outer portions thereof for extension of the plug metal casing 11 of the plug connector 1 from the outer portion into the inner portion of the housing 21. The cover unit 22 is disposed in the housing 21 in proximity to the connecting hole 211, and is movable between a closed position, as shown in FIG. 5, where the cover unit 22 closes the connecting hole 211, and an open position, as shown in FIG. 6, where the cover unit 22 opens the connecting hole 211. The cover unit 22 includes a cover plate 221 for covering the connecting hole 211, and a connecting plate 222 perpendicularly connected to the cover plate 221. The connecting plate 222 has an inclined surface 223 on one side thereof, and an elongated rod portion 224 extending outwardly from another side of the connecting plate 222 that is opposite to the inclined surface 223.

The magnetic member 23 is disposed in the housing 21, and is movable toward or away from the connecting hole 211 along a first direction ($X_1$). The magnetic member 23 can push the connecting plate 222 when moved toward the connecting hole 211 so as to shift the cover unit 22 from the closed position to the open position along a second direction ($X_2$) that is perpendicular to the first direction ($X_1$). The first direction ($X_1$) is similar to a plugging/unplugging direction of the plug connector 1.

The biasing member 24 is connected to the housing 21 and the connecting plate 222 for biasing the cover unit 22 toward the closed position along the second direction ($X_2$). In this embodiment, the biasing member 24 is a compression spring that is sleeved on the rod portion 224 and that has one end abutting against the connecting plate 222, and the other opposite end abutting against a blocking plate 212 which is provided in the housing 21. The blocking plate 212 is disposed transversely of the rod portion 224, and has an abutment surface 213 abutting against the other opposite end of the biasing member 24, and a through hole 214 for extension of the rod portion 224 movably therethrough.

The limiting unit 25 includes a first limiting mechanism 251 and a second limiting mechanism 252 both fixed in the housing 21. The first limiting mechanism 251 includes a first main plate 2510 extending along the first direction ($X_1$), two first limiting plates 253 that are connected transversely and respectively to and that extend downwardly and respectively from two opposite ends of the first main plate 2510 which extend along the first direction ($X_1$), and a first stop plate 254 connected transversely to another end of the first main plate 2510 that extends along the second direction ($X_2$) and connected between the first limiting plates 253. The first main plate 2510, the first limiting plates 253, and the first stop plate 254 cooperate with the housing 21 to define a first receiving slot 2511 for receiving slidably the magnetic member 23 and for restricting sliding movement of the same therewithin and along the first direction ($X_1$). The magnetic member 23 is in slidable contact with the first limiting plates 253. The first stop plate 254 is located distal from the connecting hole 211 to stop the magnetic member 23 and to prevent the same from moving too far away from the connecting hole 211.

The second limiting mechanism 252 includes a second main plate 2520 extending along the second direction ($X_2$), a second limiting plate 255 that is disposed transversely of the second main plate 2520 and that extends along the second direction ($X_2$), and a second stop plate 256 that is connected to the second limiting plate 255 and that extends along the first direction ($X_1$). The second main plate 2520, the second limiting plate 255 and the second stop plate 256 cooperate with the housing 21 to define a second receiving slot 2521 for receiving the connecting plate 222 and for restricting movement of the same along the second direction ($X_2$). The second receiving slot 2521 communicates with the first receiving slot 2511. The second stop plate 256 is disposed distal from the connecting hole 211 to stop the connecting plate 222 and prevent the same from moving too far away from the connecting hole 211.

The circuit board 3 is installed in the housing 21. The socket connector 4 is connected electrically to the circuit board 3, and is fixed to the same at a position that is proximate to the connecting hole 211 for removable insertion of the plug connector 1 therein after the plug connector 1 passes through the connecting hole 211. The socket connector 4 includes a socket metal casing 41 that defines a plugging space (not shown) for accommodating the plug metal casing 11 of the plug connector 1.

Figure 3:
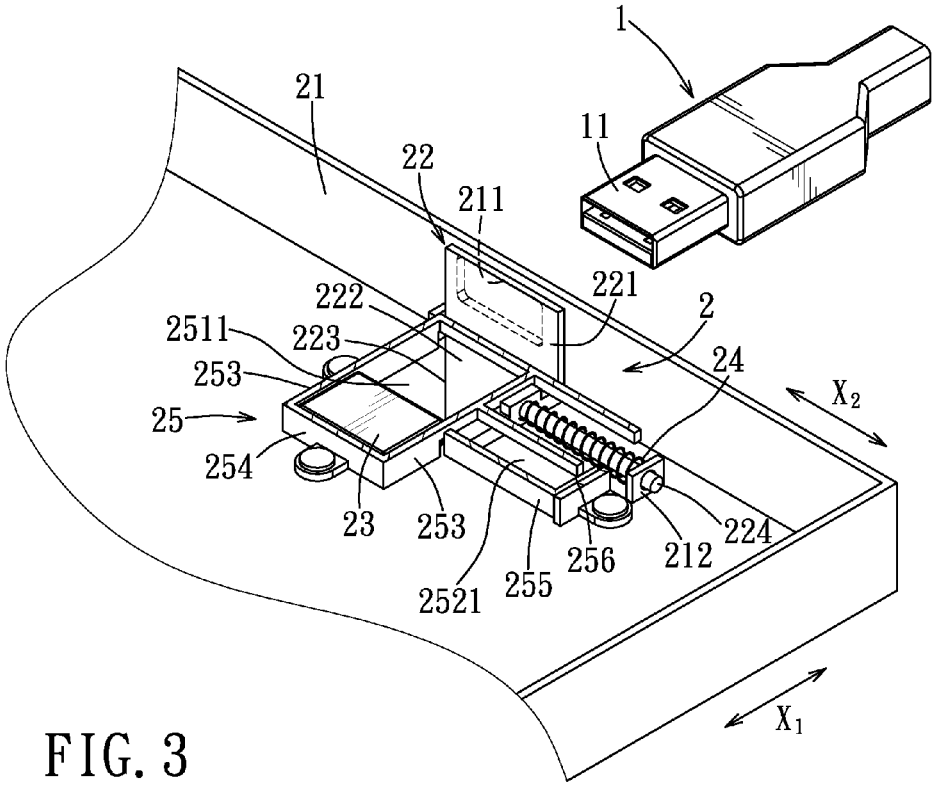
FIG. 3 is a view similar to FIG. 1, but with a socket connector and a circuit board being removed for the sake of clarity.

Referring to FIG. 5, in combination with FIG. 3, when the plug connector 1 is not connected to the socket connector 4 and is distal from the connecting hole 211, the cover unit 22 is in the closed position and the cover plate 221 closes the connecting hole 211 of the housing 21. Through this, a protective effect for preventing dust or foreign matters from entering the housing 21 can be achieved.

As shown in FIG. 6, to plug the plug connector 1 into the socket connector 4, the plug connector 1 is moved close to the connecting hole 211 from the outer portion of the housing 21 so as to magnetically pull the magnetic member 23 to move toward the connecting hole 211 along the first direction ($X_1$) through magnetic attraction of the plug metal casing 11 of the plug connector 1. As the magnetic member 23 moves toward the connecting hole 211, it pushes the inclined surface 223 of the connecting plate 222 so that the connecting plate 222 is moved from the first receiving slot 2511 to the second receiving slot 2521 along the second direction ($X_2$). During this time, the cover plate 221 moves along with the connecting plate 222 to uncover the connecting hole 211, thereby shifting the cover unit 22 from the closed position to the open position. Thus, the connecting hole 211 is opened, and the plug metal casing 11 of the plug connector 1 can smoothly enter the inner portion of the housing 21 for electrical connection with the socket connector 4.

The connecting plate 222 abuts against the second stop plate 256 when the cover unit 22 is at the open position, and cooperates with the blocking plate 212 to compress the biasing member 24. When the plug connector 1 is unplugged from the socket connector 4 and is moved away from the connecting hole 211, the magnetic member 23 is no longer subject to the magnetic attraction of the plug metal casing 11 and releases the pushing force against the connecting plate 222. Simultaneously, compression on the biasing member 24 by the connecting plate 222 is released, and due to its restoring force, the biasing member 24 is restored from a compressed state to a non-compressed state, and pushes the connecting plate 222 to move from the second receiving slot 2521 to the first receiving slot 2511 along the second direction ($X_2$). During this time, the cover plate 221 moves along with the connecting plate 222 to cover the connecting hole 211, thereby shifting the cover unit 22 from the open position to the closed position (see FIG. 5). The biasing member 24 is designed to bias the cover unit 22 toward the closed position. Hence, automatic opening and closing of the cover module 2 can be achieved.

During movement of the connecting plate 222 to its original position in the first receiving slot 2511 through the biasing force of the biasing member 24, the inclined surface 223 of the connecting plate 222 pushes the magnetic member 23 to move away from the connecting hole 211 along the first direction ($X_1$) and return to its initial position, where the magnetic member 23 abuts against the first stop plate 254. Through this, the same steps can be repeated for the next plugging operation of the plug connector 1.

Figure 4:
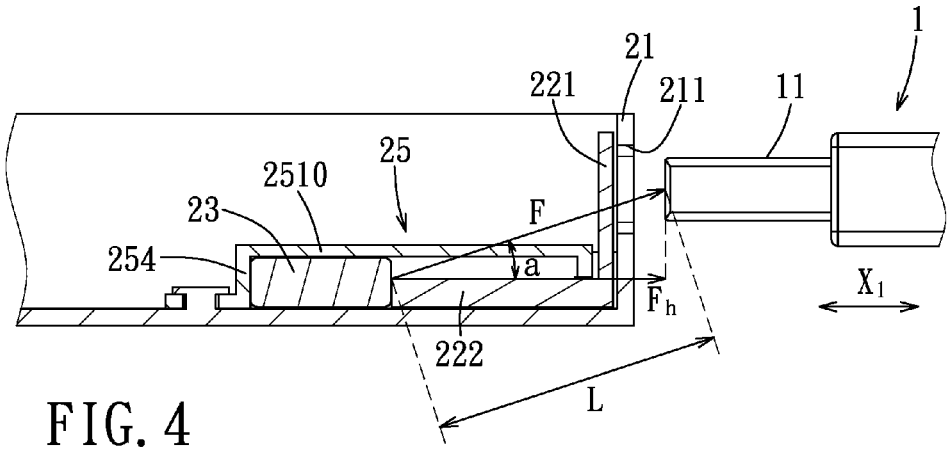
FIG. 4 is a fragmentary sectional side view of the first embodiment in an assembled state.

With reference to FIGS. 4 to 6, a theoretical design basis of the component parameters of the present embodiment will be described hereinafter. When the plug metal casing 11 approaches the connecting hole 211 and magnetically attracts the magnetic member 23, according to Coulomb's law, the magnetic attraction force (F) received by the magnetic member 23 is $F=K_m \cdot M_1 \cdot M_2/L^2$, where $K_m$ represents the Coulomb's constant, $M_1$ and $M_2$ respectively represent magnetic intensities of the magnetic member 23 and the plug metal casing 11, and L represents a magnetic distance between the magnetic member 23 and the plug metal casing 11. If the magnetic force direction between the magnetic member 23 and the plug metal casing 11 forms an included angle (a) with the first direction ($X_1$), then a magnetic force component exerted on the magnetic member 23 along the first direction ($X_1$) is $F_h=F \cdot \cos(a)$. If the inclined surface 223 of the connecting plate 222 forms an included angle (b) with the first direction ($X_1$), then when the magnetic member 23 moves along the first direction ($X_1$) and pushes the inclined surface 223, the connecting plate 222 will receive a force component along the second direction ($X_2$) which is $F_y=F_h \cdot \sin(b) \cdot \cos(b)$. When the magnetic member 23 is displaced at a distance ($D_m$) along the first direction ($X_1$), it pushes the connecting plate 222 through the inclined surface 223 thereof to move along the second direction ($X_2$) and displace a distance ($D_s$), that is, $D_s=D_m \cdot \tan(b)$. The distance ($D_s$) is equivalent to the amount of compressing the biasing member 24. Thus, during displacement of the connecting plate 222, it will receive an elastic biasing force ($F_s$) of the biasing member 24, that is, $F_s=K_s \cdot D_s$, where $K_s$ is the elastic constant of the biasing member 24. Therefore, in order for the magnetic member 23 to have a sufficient force to push the connecting plate 222 so that the cover unit 22 can reach the open position, the condition $F_y>F_s$ should be satisfied. Substituting the aforesaid derivation, the below formula is obtained $$K_m \cdot M_1 \cdot M_2 \cdot \cos(a) \cdot \cos(b)^2/L^2 > K_s \cdot D_m$$

This is the parameter design requirement of the embodiment under an ideal condition that the frictional force may be ignored.

It should be noted that the socket metal casing 41 is made of a non-magnetic material (e.g., partially stainless steel) in this embodiment. Hence, the magnetic member 23 will not be magnetically attracted to the socket metal casing 41 and will not receive additional magnetic interference when magnetically pulled by the plug metal casing 11. Furthermore, in this embodiment, a portion of the limiting unit 25 is integrally connected to the housing 21, and cooperates with the housing 21 to confine therebetween the magnetic member 23 and the connecting plate 222 to achieve the effect of limiting the displacement direction of the magnetic member 23 and the connecting plate 222. It is well understood that the limiting unit 25 may be altered according to the shape of the housing 21, that is, it may provide different numbers and shapes of the first and second limiting plates 253, 255, as long as the limiting unit 25 may cooperate with the housing 21 to limit the magnetic member 23 and the connecting plate 222. The limiting unit 25 may also be designed not to cooperate with the housing 21 and may independently limit the magnetic member 23 and the connecting plate 222, as long as the magnetic member 23 and the connecting plate 222 may be limited to move along the first direction ($X_1$) and the second direction ($X_2$), respectively.

Figure 7:
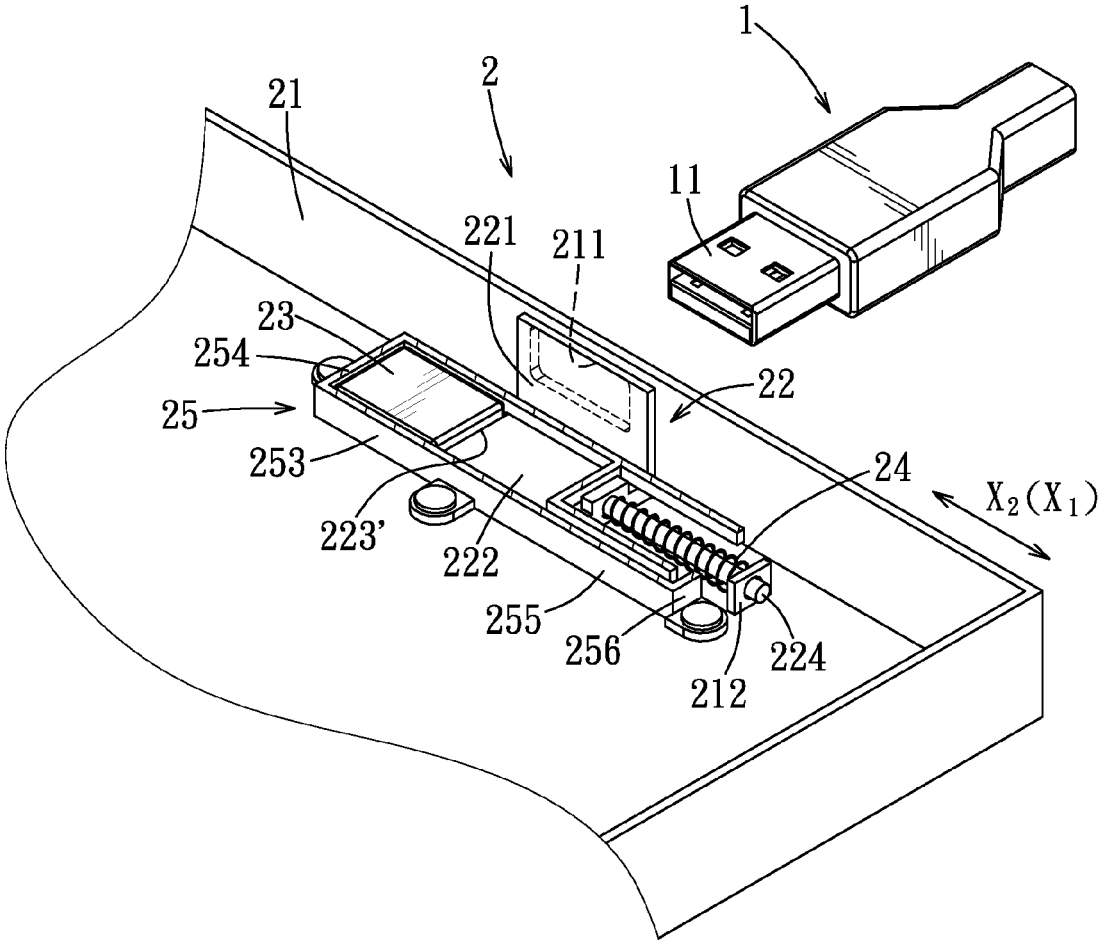
FIG. 7 is a fragmentary perspective view of a cover module according to the second embodiment of the present invention.
Figure 8:
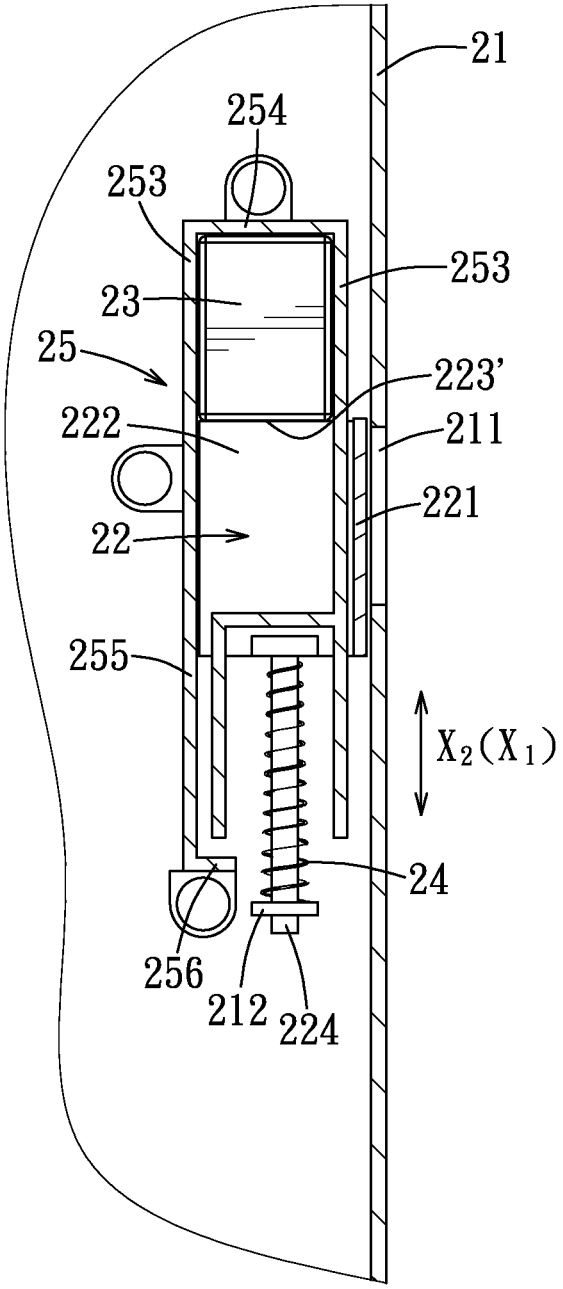
FIG. 8 is a fragmentary sectional top view of the second embodiment, illustrating a cover unit in a closed position.
Figure 9:
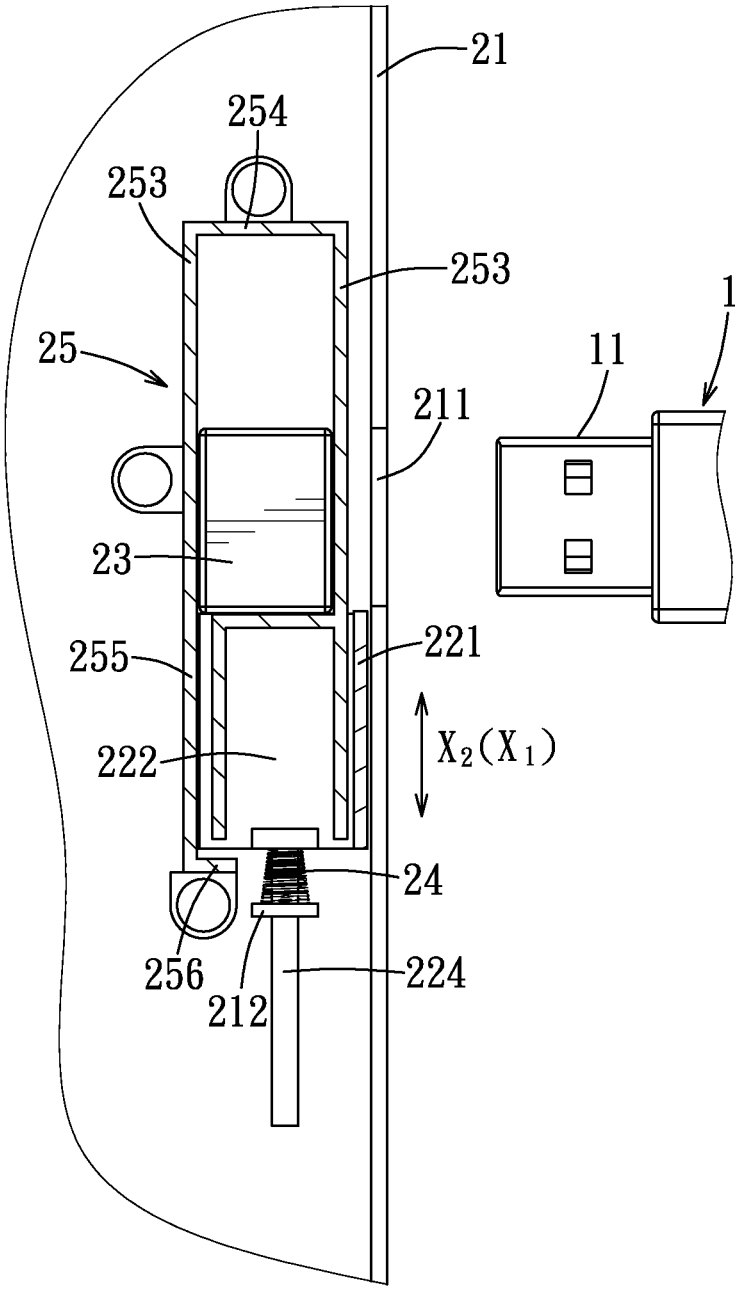
FIG. 9 is a view similar to FIG. 8, but illustrating the cover unit in an open position.

Referring to FIGS. 7 to 9, the second embodiment of the cover module 2 according to this invention is shown to be substantially similar to the first embodiment. However, in this embodiment, the magnetic member 23 moves in a direction ($X_1$) the same as that of the connecting plate 222, which is along the second direction ($X_2$), and is perpendicular to the plugging/unplugging direction of the plug connector 1. Further, the inclined surface 223 of the connecting plate 222 in the first embodiment is changed to a flat planar surface 223' to abut against the magnetic member 23.

As the plug connector 1 is moved close to the connecting hole 211, the magnetic member 23 is magnetically pulled by the plug metal casing 11 of the plug connector 1 to move toward the connecting hole 211 along the second direction ($X_2$), and simultaneously pushes the connecting plate 222 to move toward the biasing member 24 and compress the same. During this time, the cover plate 221 moves along with the connecting plate 222 to uncover the connecting hole 211, thereby shifting the cover unit 22 from the closed position to the open position. The effect of opening the connecting hole 211 for insertion of the plug connector 1 therein is thus achieved.

Figure 10:
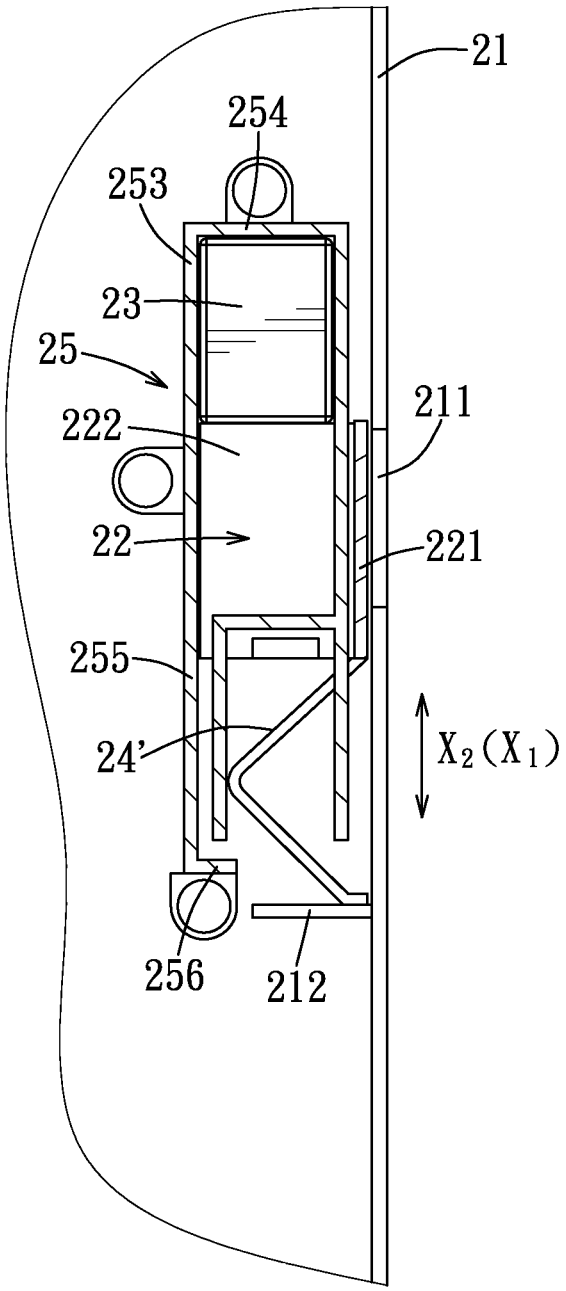
FIG. 10 is a view similar to FIG. 8, but illustrating an alternative form of a biasing member.

In the foregoing two embodiments, the biasing member 24 is a compression spring that is sleeved on the rod portion 224 of the connecting plate 222. Nevertheless, the biasing member 24 may be altered to other equivalent component having a resilient biasing force. FIG. 10 illustrates an alternative form of the biasing member 24'. In this case, the biasing member 24' is a spring plate. Hence, the form of the biasing member 24 is not limited to the aforesaid disclosure. As long as the biasing member 24 is able to provide a restoring force for restoring the cover unit 22 from the open position to the closed position, any form thereof is acceptable. Furthermore, in the foregoing embodiments, the first electronic component is a plug connector 1, while the second electronic component is a socket connector 4. However, in actual practice, the first electronic component may be a memory card, a floppy disk, etc., whereas the second electronic component may be a card reader, a disk drive, etc. As long as the first electronic component is able to magnetically attract the magnetic member 23 when approaching the connecting hole 211 so as to move the cover unit 22 of the cover module 2 to the open position, any form thereof is acceptable.

In summary, through the presence of the magnetic member 23, when the plug connector 1 approaches the connecting hole 211, the magnetic member 23 is magnetically pulled by the plug connector 1 to displace, simultaneously pushing the cover unit 22 to move to the open position, thereby opening the connecting hole 211 for insertion of the plug connector 1 therein. When the plug connector 1 is unplugged and is moved away from the connecting hole 211, the cover unit 22 can be restored to the closed position through the restoring force of the biasing member 24 so as to cover the connecting hole 211. In such a manner, the effect of automatically closing and opening the cover module 2 can be achieved without having to free an empty hand to perform such operations nor move the line of sight to confirm the position of the cover module 2. Moreover, the user does not have to go into a narrow and dark space, where an electronic device is placed, to operate the cover module 2. Therefore, the object of this invention is realized.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A cover module for installation in an electronic device, said cover module being opened when a first electronic component having a metal housing made of a magnetic material approaches said cover module, said cover module comprising:

a housing provided with a connecting hole communicating with inner and outer portions thereof;

a cover unit disposed in said housing in proximity to said connecting hole, said cover unit being movable between a closed position, where said cover unit closes said connecting hole, and an open position, where said cover unit opens said connecting hole, said cover unit including a cover plate for covering said connecting hole, and a connecting plate connected to said cover plate;

a magnetic member disposed in said housing, wherein when the first electronic component approaches said connecting hole, said magnetic member is magnetically pulled by the metal housing of the first electronic component to move toward said connecting hole, simultaneously pushing said connecting plate to shift said cover unit from said closed position to said open position;

a biasing member connected to said housing and said connecting plate for biasing said cover unit toward said closed position; and a limiting unit fixed to said housing and including a first limiting mechanism, said first limiting mechanism including a first limiting plate that cooperates with said housing to define a first receiving slot which receives slidably said magnetic member and which restricts sliding movement of said magnetic member therewithin.

2. The cover module as claimed in claim 1, further comprising a second electronic component disposed in said housing in proximity to said connecting hole for removable insertion of the first electronic component therein after the first electronic component passes through said connecting hole.

3. The cover module as claimed in claim 2, the first electronic component is a plug connector, and the metal housing of the first electronic component is a plug metal housing, wherein said second electronic component is a socket connector which has a socket metal casing made of a non-magnetic material.

4. The cover module as claimed in claim 2, further comprising a circuit board installed in said housing and connected electrically to said second electronic component.

5. The cover module as claimed in claim 1, wherein said connecting plate has an inclined surface, and said magnetic member pushes said inclined surface when moved toward said connecting hole.

6. The cover module as claimed in claim 1, wherein said first limiting mechanism further includes a first stop plate that is disposed transversely of said first limiting plate and that is distal from said connecting hole to stop said magnetic member from moving too far away from said connecting hole.

7. The cover module as claimed in claim 3, wherein said first limiting mechanism includes two said first limiting plates that are spaced apart from each other and that extend along a first direction, said magnetic member being movable toward said connecting hole along said first direction, said cover unit being movable between said closed position and said open position along a second direction that is perpendicular to said first direction, said limiting unit further including a second limiting mechanism, said second limiting mechanism including a second limiting plate that cooperates with said housing to define a second receiving slot for receiving said cover unit and for restricting movement of said cover unit along said second direction, said second receiving slot communicating with said first receiving slot, said cover unit being moved from said first receiving slot to said second receiving slot to expose said connecting hole, and being moved from said second receiving slot to said first receiving slot to cover said connecting hole.

8. The cover module as claimed in claim 7, wherein said second limiting mechanism further includes a second stop plate that is fixed in said housing distal from said connecting hole, that is disposed transversely of said second limiting plate, and that extends along said first direction to stop said connecting plate from moving too far away from said connecting hole.

9. The cover module as claimed in claim 1, wherein a portion of said limiting unit is integrally connected to said housing.

10. The cover module as claimed in claim 1, wherein said connecting plate is perpendicular to said cover plate.

11. The cover module as claimed in claim 7, wherein said first direction is similar to a plugging/unplugging direction of the plug connector.

12. The cover module as claimed in claim 1, wherein said connecting plate has a rod portion extending outwardly therefrom, and said biasing member is a compression spring that is sleeved on said rod portion.

13. The cover module as claimed in claim 12, wherein said housing is further provided with a blocking plate that is disposed transversely of said rod portion, said blocking plate having an abutment surface, and a through hole for extension of said rod portion movably therethrough, said biasing member having two opposite ends respectively abutting against said connecting plate and said abutment surface.

14. The cover module as claimed in claim 1, wherein said cover module is a dustproof cover module.

* * * * *